US005077904A

United States Patent [19]

Michael

[11] Patent Number: 5,077,904

[45] Date of Patent: Jan. 7, 1992

[54] DRAFTING APPARATUS

[76] Inventor: James K. Michael, 3321 Wuthering Height, Richmond, Va. 23234

[21] Appl. No.: 612,916

[22] Filed: Nov. 14, 1990

[51] Int. Cl.[5] ..... B43L 13/14

[52] U.S. Cl. ..... 33/432; 33/434; 33/DIG. 1

[58] Field of Search ..... 33/DIG. 1, 432, 433, 33/434, 430, 438, 1 K, 465, 431, 471

[56] References Cited

U.S. PATENT DOCUMENTS

| | | | |
|---|---|---|---|
| 21,336 | 8/1858 | Hansell | 33/433 |
| 1,122,533 | 12/1914 | Ogilvie | 33/433 |
| 1,705,330 | 3/1929 | Martinelli et al. | 33/433 |
| 2,568,575 | 9/1951 | Wickman | 33/DIG. 1 X |
| 2,581,839 | 1/1952 | Douglas | 33/430 X |
| 2,667,694 | 2/1954 | McQuaid | 33/432 |
| 3,389,470 | 6/1968 | Johnson | 33/434 |
| 3,464,117 | 9/1969 | Johnson | 33/434 |
| 3,881,253 | 5/1975 | Haws | 33/430 X |

FOREIGN PATENT DOCUMENTS

| | | | |
|---|---|---|---|
| 1206363 | 8/1959 | France | 33/DIG. 1 X |
| 399955 | 4/1966 | Switzerland | 33/DIG. 1 |
| 2143779 | 2/1985 | United Kingdom | 33/432 |

*Primary Examiner*—Harry N. Haroian
*Attorney, Agent, or Firm*—Staas & Halsey

[57] ABSTRACT

A drafting apparatus comprising a drawing board having at least two opposite, parallel sides, and arcuate guide means, detachably coupled to the at least two opposite, parallel sides, for guiding a straight edge along a radial path during formation of radiating perspective lines.

7 Claims, 21 Drawing Sheets

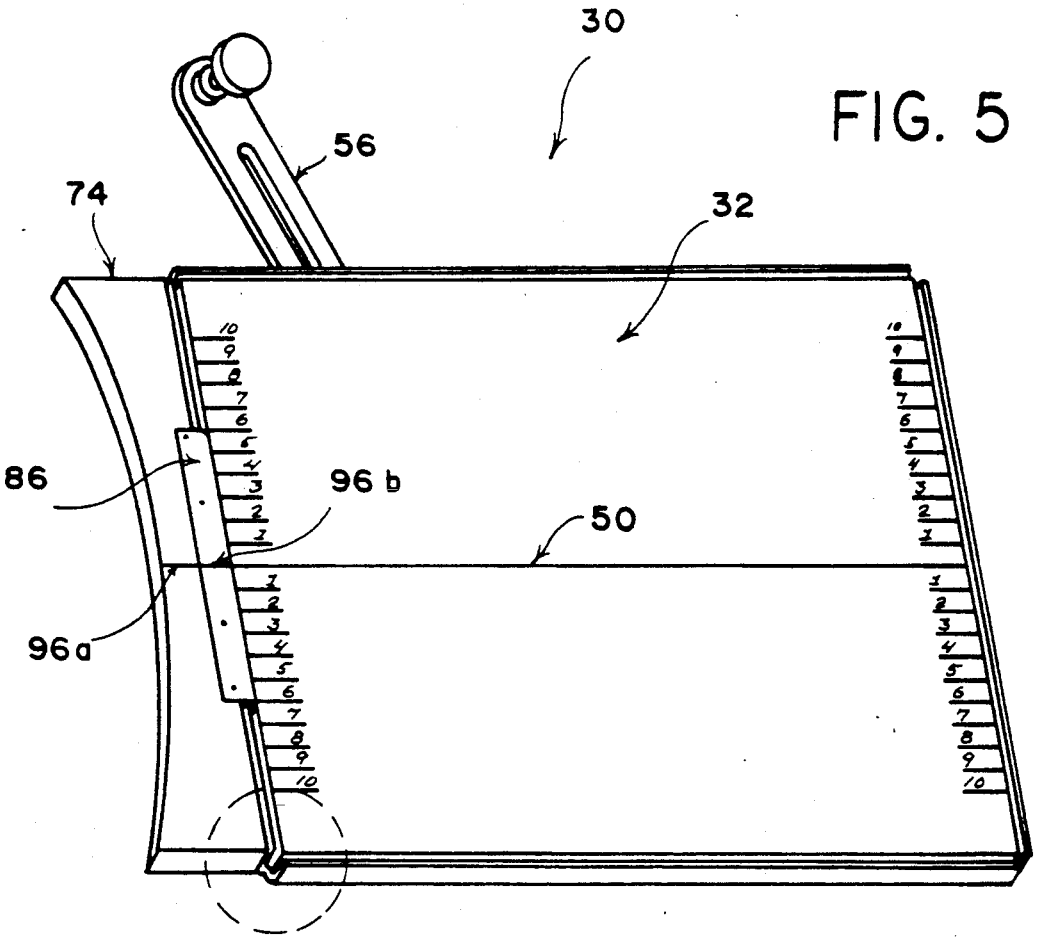
FIG. 5
FIG. 5(A)
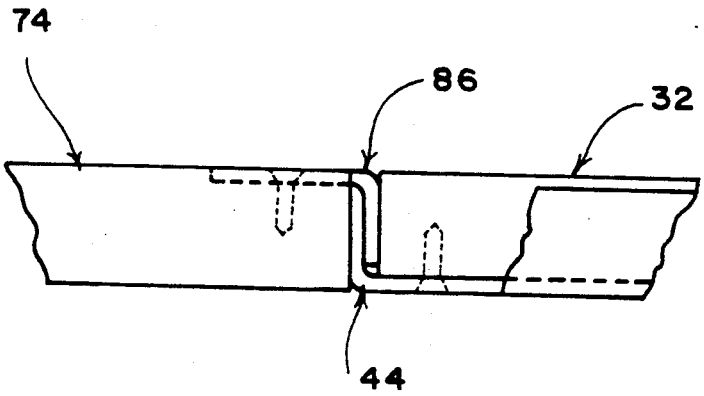

DRAFTING APPARATUS

BACKGROUND OF THE INVENTION

1. Field of the Invention

The present invention relates generally to the field of mechanical and architectural drafting and, more specifically, to a drafting apparatus useful in making perspective renderings.

2. Description of the Related Art

Various drafting techniques are used for making perspective renderings by architects and mechanical engineers or designers. One technique involves the use of drafting Mylar overlays that can be purchased in various forms. These overlays are thin sheets 11×14 inches or 16×20 inches and can be used to transfer alignment dots to a rendering of a structure so as to enable the designer to keep brick lines, board lines, or window lines at a given angle. Unfortunately, this is a slow and difficult process.

A known drafting apparatus for creating perspective renderings is known as the "P-3" or three-point perspective drawing instrument. This instrument is used for drawing small 30° isometric-type renderings, and includes a drawing board having arcuate channels formed in the drawing surface of the board at opposite ends, with each arcuate channel having a different radius. The instrument is small and has some serious limitations. Essentially, it can only provide a 30° isometric perspective and only one horizon line, so that its use is limited to small, non-serious architectural drawings. A T-square slides in and is guided by the grooves, and can be transferred from one groove to the other.

The P-3 instrument is limited in that it only provides a partial arc, and the arcuate grooves are permanently fixed so that only 30° isometric renderings can be created. Moreover, the drawing board itself has to be turned in several different ways to actually achieve multiple uses. For example, if you needed a particular horizon line, you would have to turn the board away from the designer to achieve a horizon line with a wide arc. If the designer desires a different horizon line, the board would have to be turned another way, but in any case, a complete arc is not available and this restricts the horizon line. Also, since the board does not have a wide selection of arcs it does not provide a wide selection of viewpoints.

SUMMARY OF THE INVENTION

An object of the present invention is therefore to provide a drafting a which is capable of producing architectural perspective drawings quickly and easily.

Another object of the present invention is to provide a drafting apparatus which is capable of providing isometric renderings from a variety of viewpoints.

Another object of the present invention is to provide a drafting apparatus which is relatively simple in construction and cost effective to produce.

These and other objects of the invention are met by providing a drafting apparatus which includes a drawing board having at least two opposite, parallel sides, and arcuate guide means, detachably coupled to the at least two opposite, parallel sides, for guiding a straight edge along a radial path.

Preferably, the arcuate guide means includes a plurality of arcuate guide boards, each having a concave arcuate guide surface of a predetermined radius.

These and other features and advantages of the drafting apparatus of the present invention will become more apparent with reference to the following detailed description and drawings.

BRIEF DESCRIPTION OF THE DRAWINGS

FIG. 5 is a perspective view, similar to FIG. 1, showing the drafting apparatus according to the present invention;

FIG. 5(*a*) is an enlarged end view of a sliding mechanism used to connect the arcuate guide board to the drawing board, and taken from the broken line circle of FIG. 5;

FIG. 9(*a*) is a side elevational view of the rolling T-square of FIG. 9;

DETAILED DESCRIPTION OF THE PREFERRED EMBODIMENTS

Figure 1:
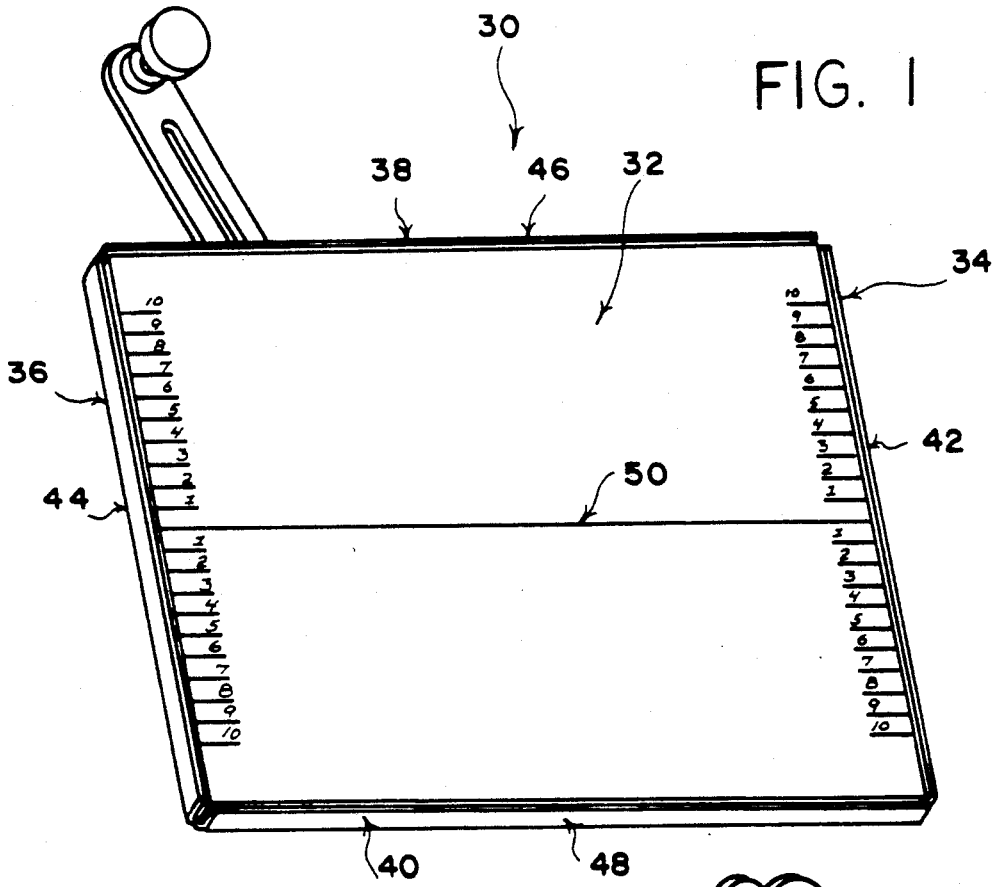
FIG. 1 is a perspective view of a drawing board used in the drafting apparatus according to the present invention.
Figure 2:
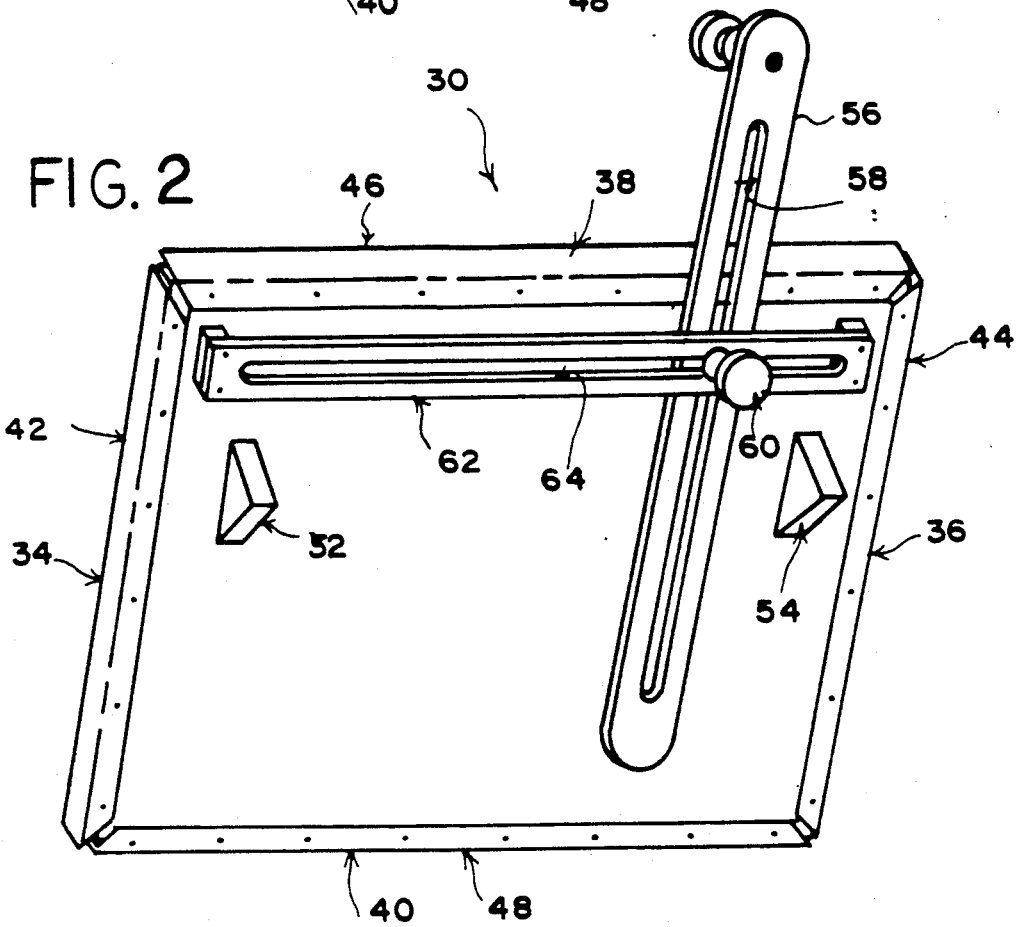
FIG. 2 is a reverse side perspective view of the drawing board of FIG. 1.

Referring to FIGS. 1 and 2, a drafting apparatus according to the present invention is generally referred to by the numeral 30 and includes a drawing board 32 which has opposite parallel sides 34 and 36 (illustrated as right and left-hand sides, respectively) and opposite parallel sides 38 and 40 (corresponding to top and bottom sides, respectively).

A track is provided along the peripheral edges of the drawing board 32 in four track segments 42, 44, 46 and 48. These track segments are used to mount other components of the drafting apparatus, which will be described below.

The upper surface of the drawing board 32, shown in FIG. 1, is provided with pick marks on the left and right-hand sides of the board, and being numbered from 1-10 above and below a horizon line 50. The horizon line 50 is placed in the middle of the drawing board 32 as a matter of convenience. When creating an architectural drawing the horizon line can be shifted up or down as required by the designer. The shifted position of the horizon can be indicated by using the pick marks, as will be described in greater detail below. Basically, these marks are points of reference for selecting a horizon line parallel to the horizon line 50, yet shifted above or below line 50 as required by the designer.

Figure 13:
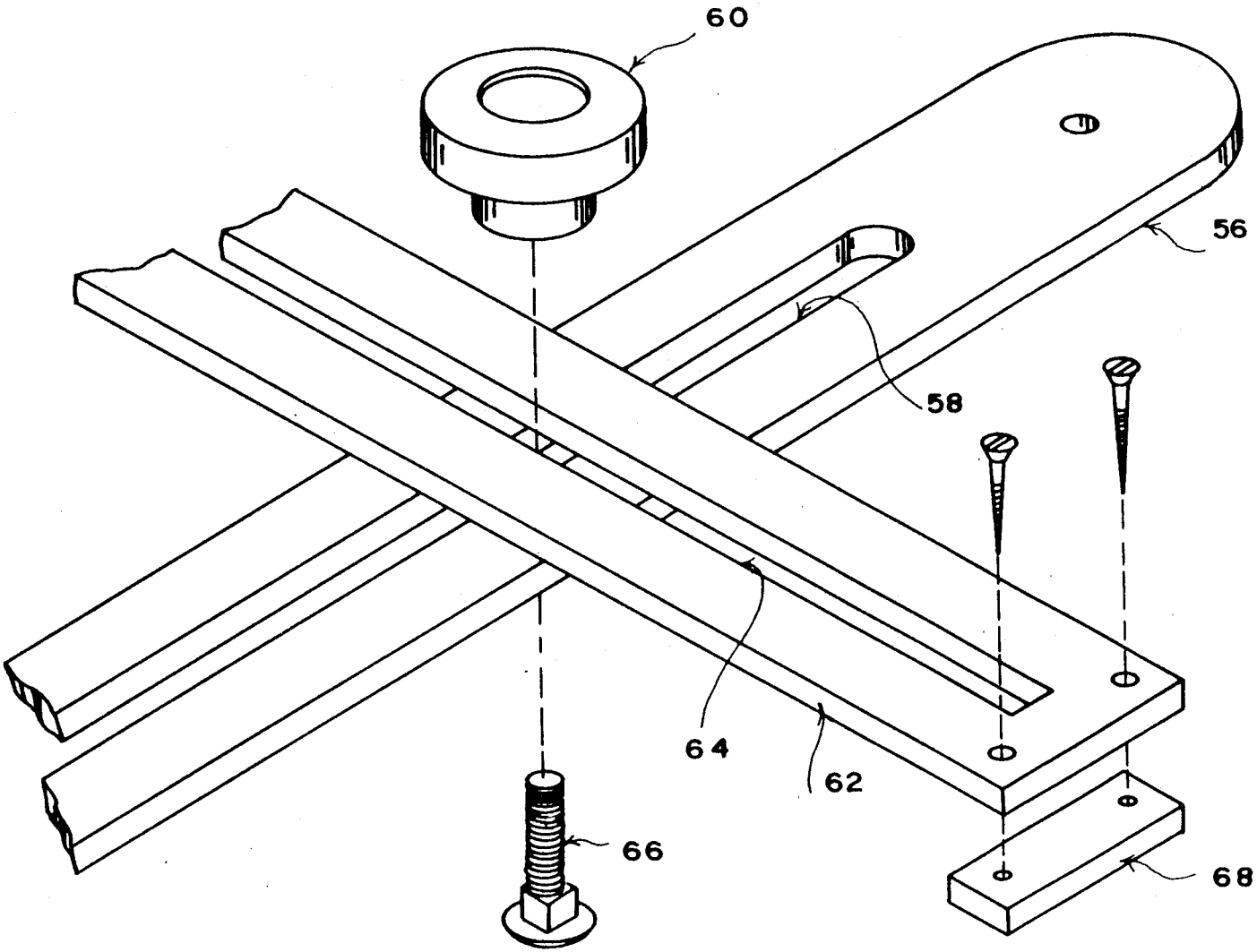
FIG. 13 is an enlarged, exploded view showing an adjustment knob for adjusting the adjustable arm relative to a mounting bar of the drawing board.

On the reverse side of the drawing board 32, as shown in FIG. 2, a pair of feet 52 and 54 are provided so as to angle the drawing board slightly upwardly when placed on a flat surface. The feet 52 and 54 also provide a space under the drawing board when resting on another surface for mounting an adjustable arm 56 which is adjustable vertically, horizontally, and angularly by means of an elongated slot 58 through which a threaded bolt 66 of an adjusting knob 60 passes. A bar 62, also provided with an elongated slot 64 is fixedly mounted on the underside of the drawing board 32 in the horizontal direction for mounting the arm 56. Referring to FIG. 13, the threaded bolt 66 passes through both of the grooves 58 and 64 and threadedly engages a central bore (not shown) of the knob 60. The position of the arm 56 can be adjusted by loosening the knob 60 and then moving the arm 56 transversely, axially, or angularly relative to the bar 62. Once a desired position is achieved, the knob 60 is tightened to lock the arm 56 in the adjusted position. A pair of spacer blocks 68 are used to mount the bar 62 in a spaced relation to the back of the drawing board 32.

Figures 3A, 3B, 3C, 3D, 3E, 3F:
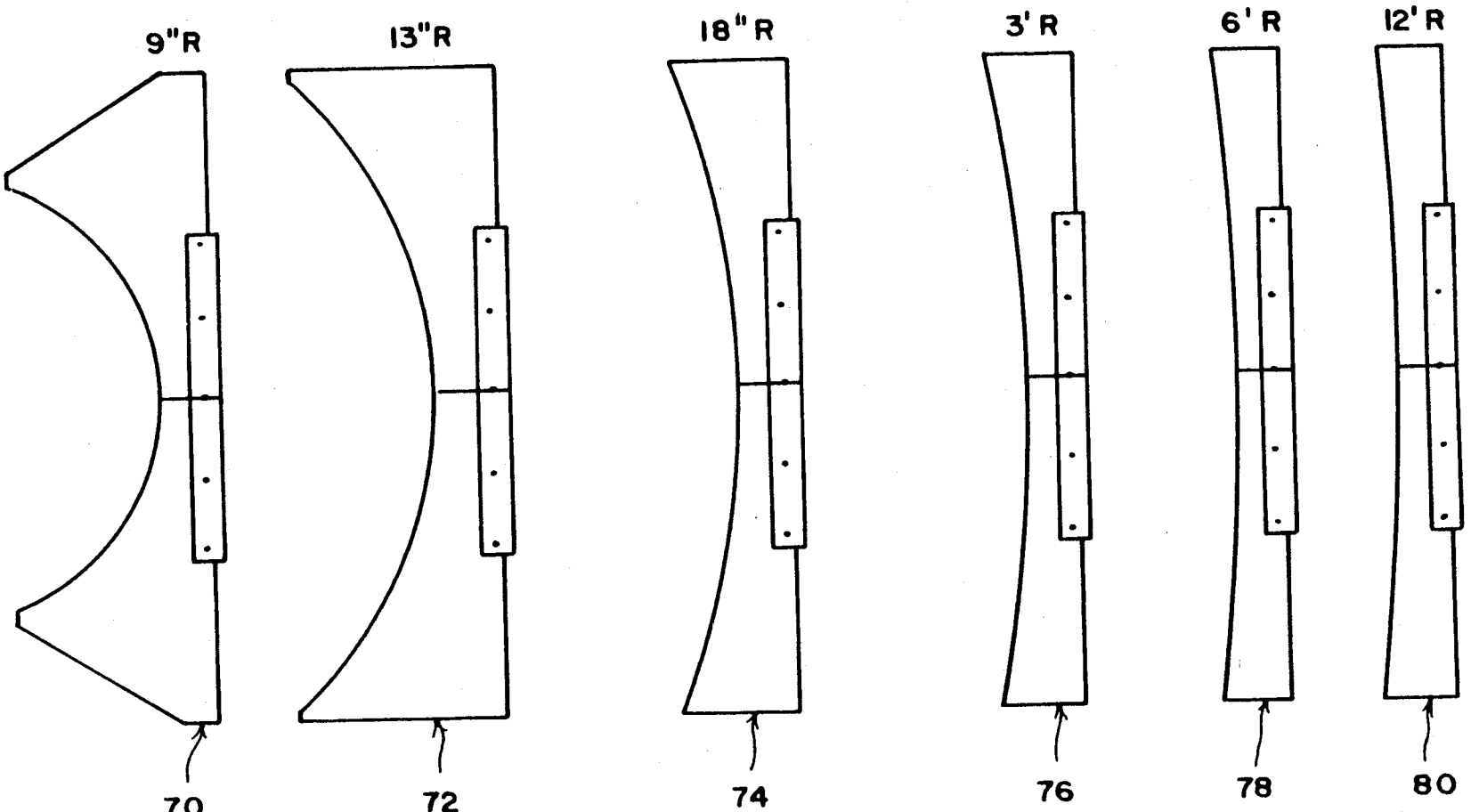
FIGS. 3(*a*)–(*f*) are top views showing arcuate guide boards of different radii, which are used in the drafting apparatus according to the present invention.
Figure 4:
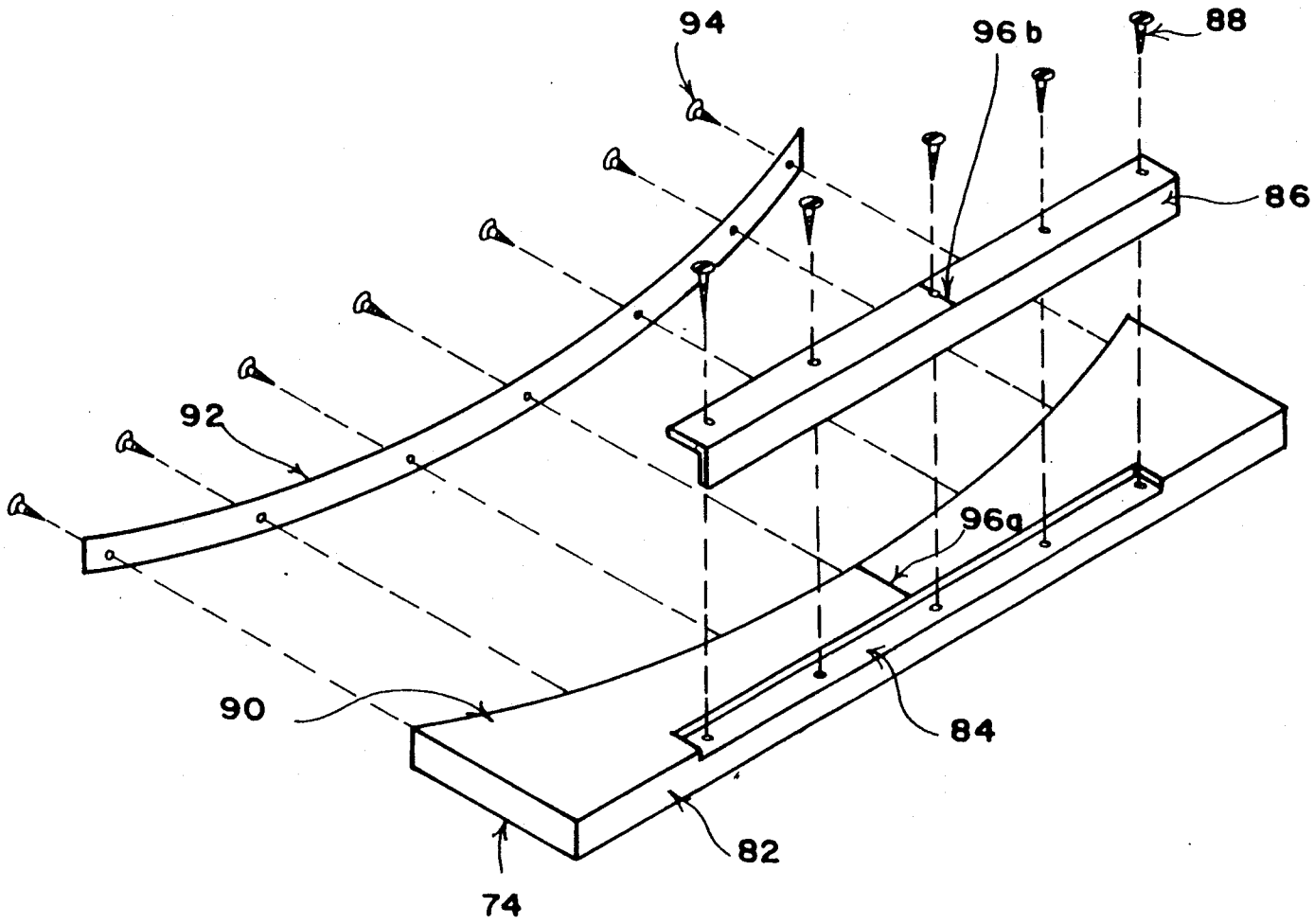
FIG. 4 is an exploded view showing details of assembly for one of the arcuate guide boards.

The track segments 42, 44, 46, and 48 are used to mount arcuate guide boards. As shown in FIGS. 3(*a*)-(*f*), the arcuate guide boards 70, 72, 74, 76, 78 and 80 are each provided with different radii. In FIGS. 3(*a*)-(*f*), the radii are progressively longer as nine inches, thirteen inches, eighteen inches, three feet, six feet and twelve feet. An exploded view of the arcuate guide board 74 is shown in FIG. 4. The overall construction of each guide board is the same; the only difference between each is the radius of curvature which defines a convex guide surface. Referring to FIG. 4, a flat side 82 of the arcuate guide board 74 is provided with a recess 84 for mounting an angle bar 86. The angle bar 86 is mounted on the guide board 74 with threaded fasteners, such as screws 88, or other suitable means. An arcuate side 90 is formed opposite the flat side 82, and has a metal rib 92 attached thereto by threaded fasteners, such as screws 94. The metal rib 92 thus provides an arcuate guide surface, or concave guide surface, the apex of which is marked by a marker line 96*a* provided on the guide board 74 and marker line 96*b*, colinear with marker line 96*a*, which is formed on the angle bar 86. The two marker lines together form a single centering line for placing the arcuate guide board on a selected horizon of the drawing board 32.

As shown in FIG. 5, the arcuate guide board 74 is detachably coupled to the left side of the drawing board 32 by interference fit of one leg of the angle bar 86 into the track segment 44 which is also preferably an angle bar which is fastened to the underside of the board 32 to define a space into which one leg of the angle bar 86 is fitted. The arcuate guide board 74, or any of the other guide boards of different radii, can be positionally adjusted by sliding along the track 44. If the center line 50 is to be used as the horizon, the centering line (made of marker lines 96*a* and 96*b*) are aligned with the center horizon line 50.

Figure 6:
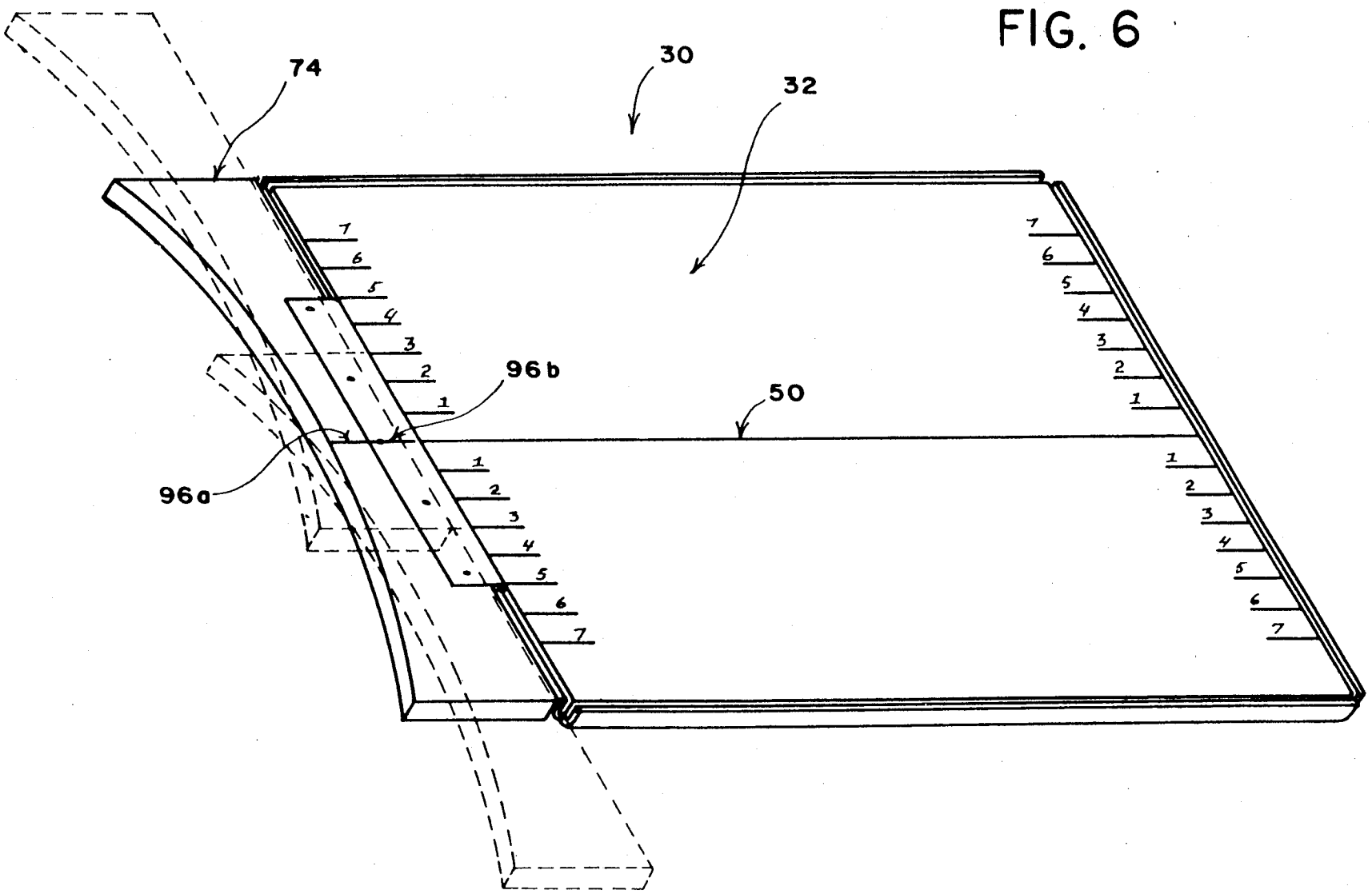
FIG. 6 is a perspective view of a drafting apparatus according to the present invention and showing sliding movement of an arcuate guide board along the left edge of the drawing board.

FIG. 6 shows the sliding movement of the arcuate guide boards 74 to adjust for different horizons, other than the center line 50. Basically, the marker lines 96*a* and 96*b* are always aligned with a selected horizon, so that, for example, if the marker lines are aligned with the number three pick mark above the center line, then the horizon would be three pick marks above the center line. In any selected position, the interference fit of the angle bar in the track is sufficient for holding the arcuate guide board in the selected position during drafting.

During use, two guide boards will be selected by the designer and attached to the opposite sides (left and right) of the drawing board. The radii of the guide boards will be selected to provide complimentary angles for the radiating perspective lines to be drawn. The radii for the right and left sides could be the same if a 45° perspective is to be drawn, or different if other views are required, such as a 30° perspective view.

Figure 7:
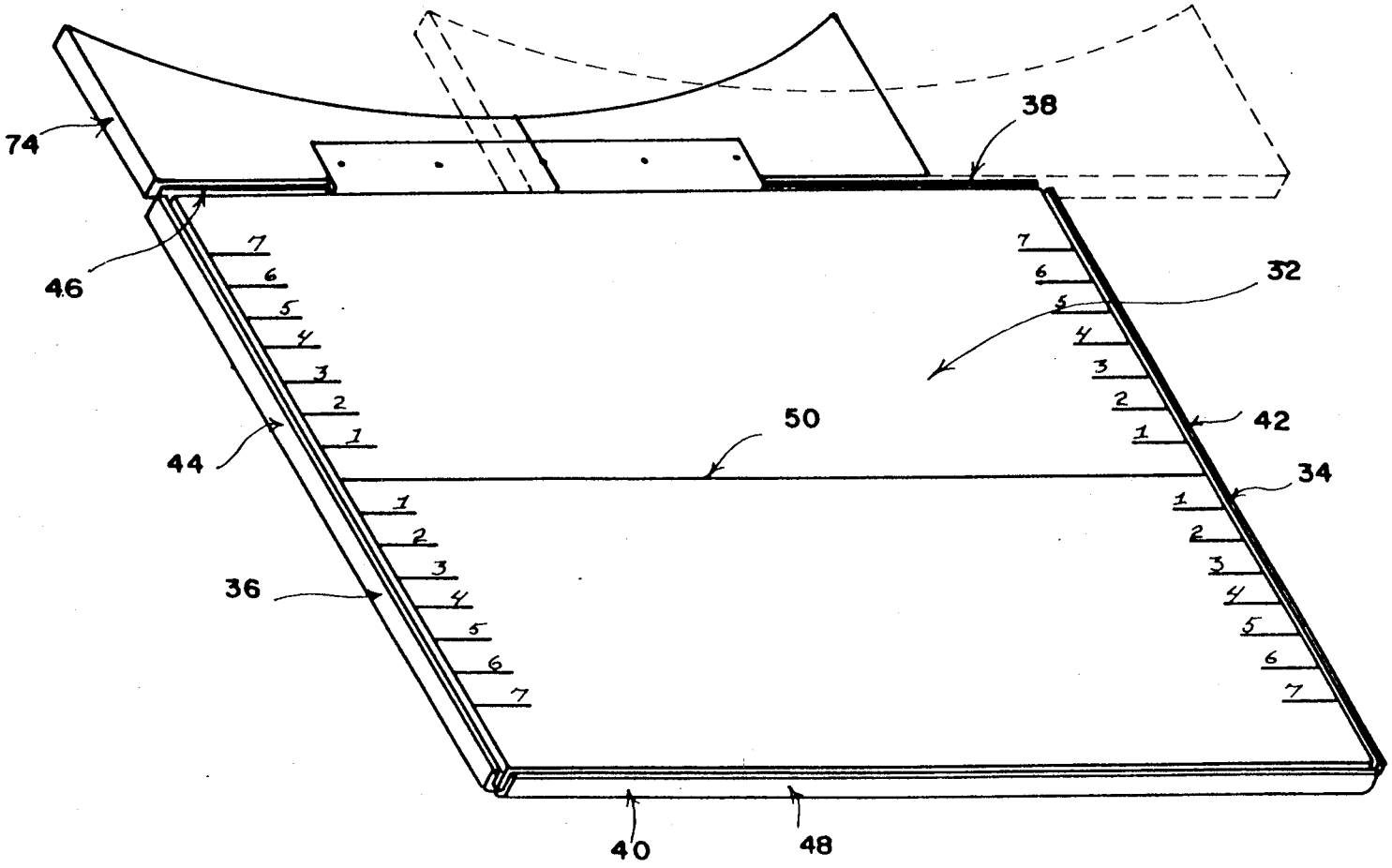
FIG. 7 is a perspective view of the drafting apparatus of the present invention, and illustrating sliding movement of an arcuate guide board along the top edge of the drawing board.

FIG. 7 shows that the arcuate guide board 74 can be attached to the upper track 46, and a complimentary angle could be formed of attaching another guide board to the lower track. By itself, a guide board on the upper track could be used to drawn rooflines, for example, when the guide board guides a T-square, as described below.

Figure 8:
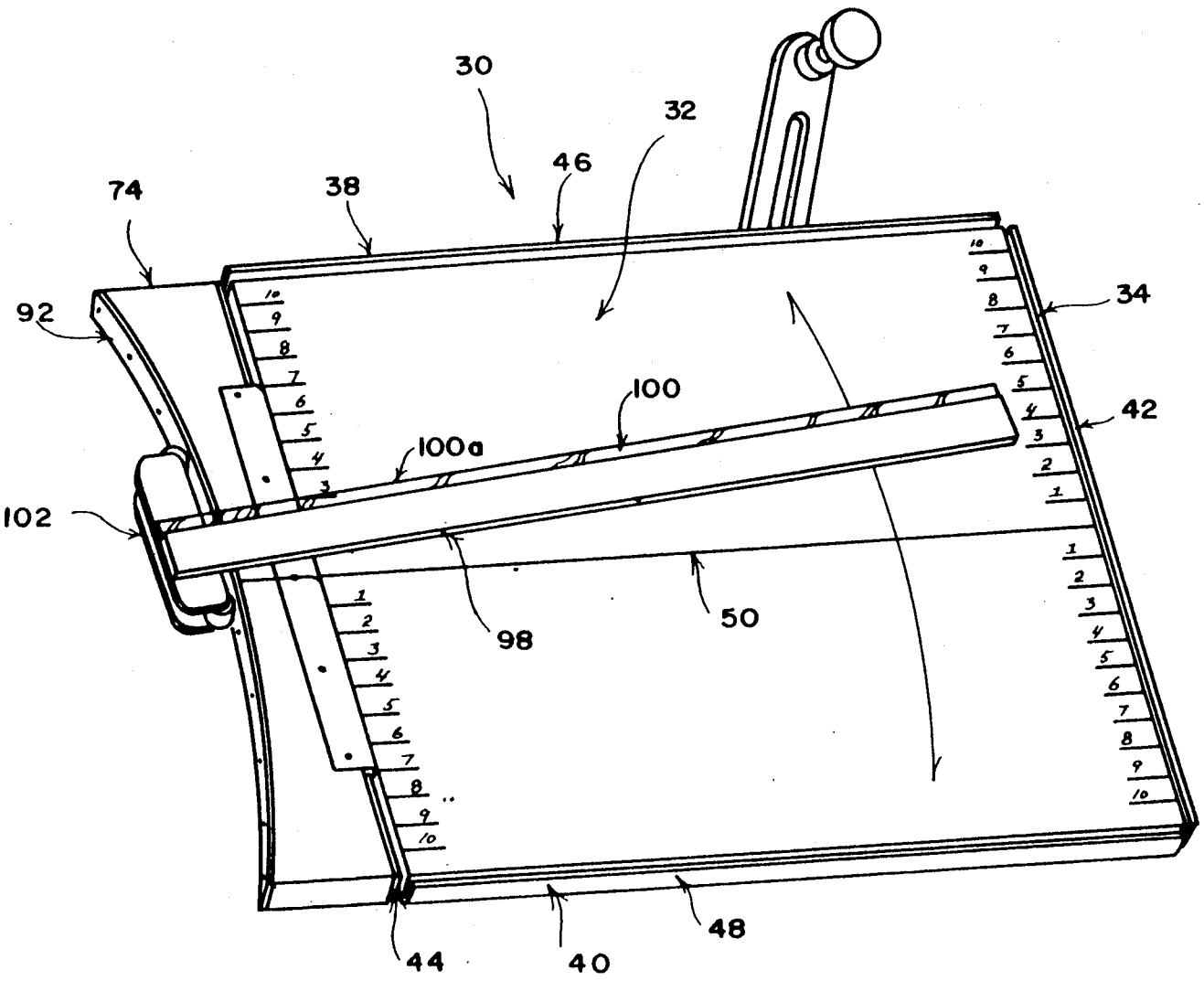
FIG. 8 is a perspective view of the drafting apparatus according to the present invention, including an arcuate guide board on the left edge and a rolling T-square guided by the arcuate guide board.

Operation of the drafting apparatus 30 of the present invention can be seen with reference to FIG. 8, wherein a T-square 98 is guided along an arcuate path so that a straight edge portion 100 of the T-square can be used to draw radiating perspective lines, radiating from a pivot point located outside the drawing board. The lines which are drawn from the straight edge portion 100 are always at 90° to a tangent of the arc of the guide surface at the point of intersection of the arc and the straight edge 100. Thus, along the entire length of the arc all of the radiating perspective lines will be at 90° to the corresponding tangent where the radiating lines intersect the arc.

Figure 9:
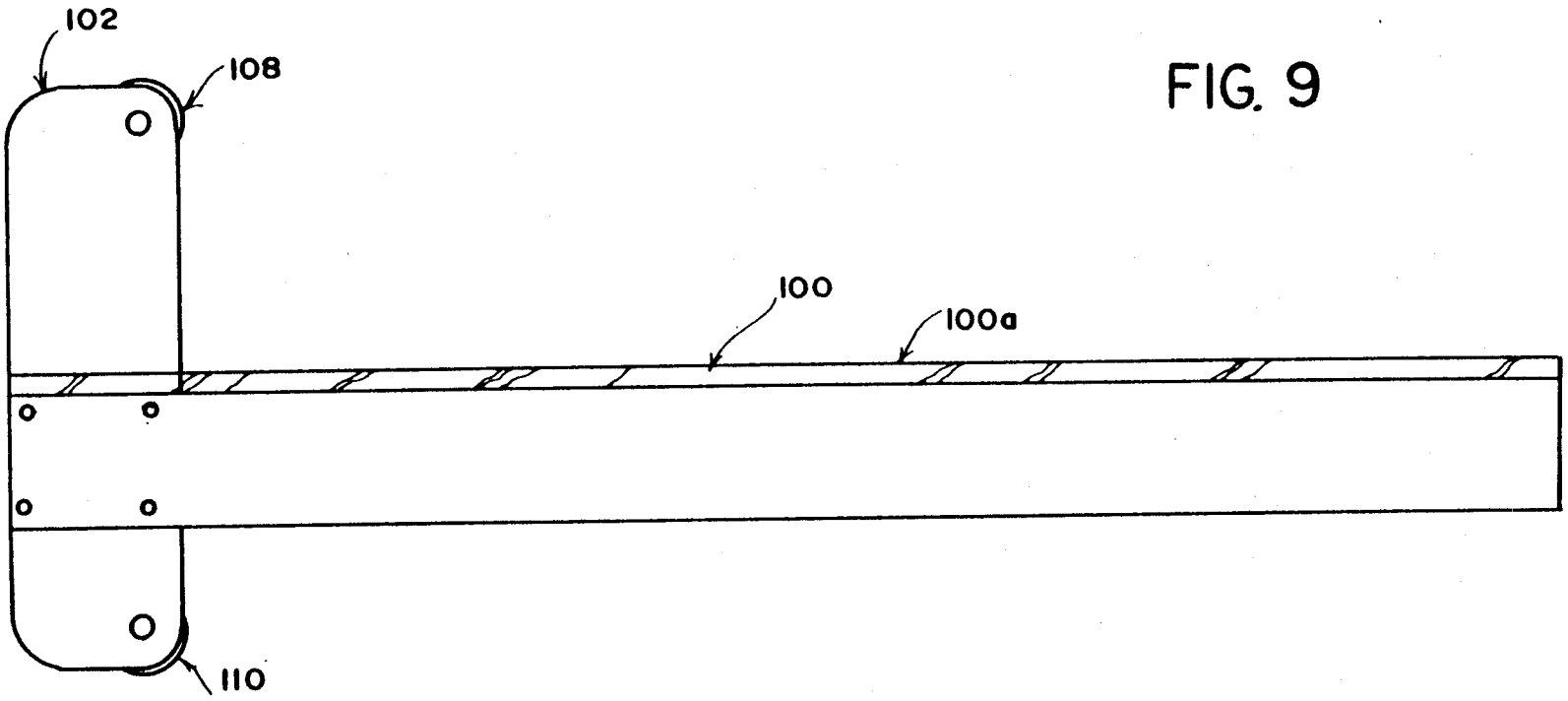
FIG. 9 is a top view of the rolling T-square shown in FIG. 8.
Figure 9A:
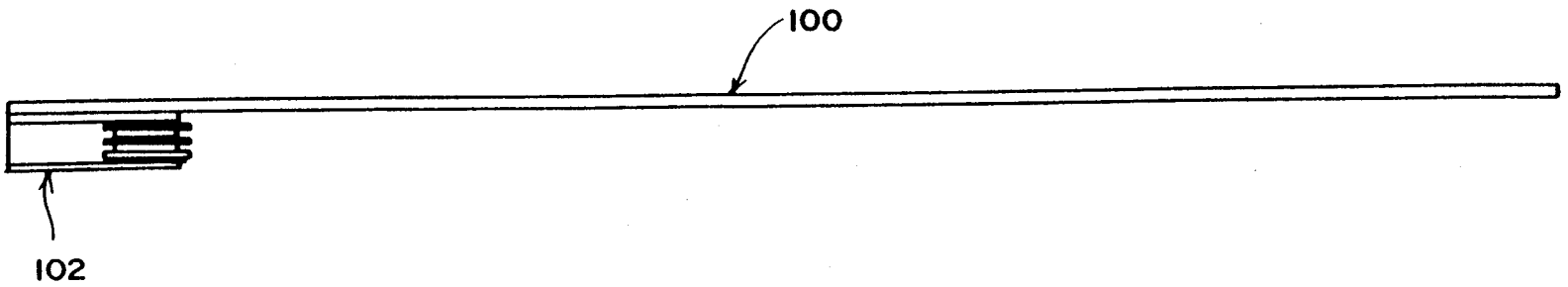
Figure 10:
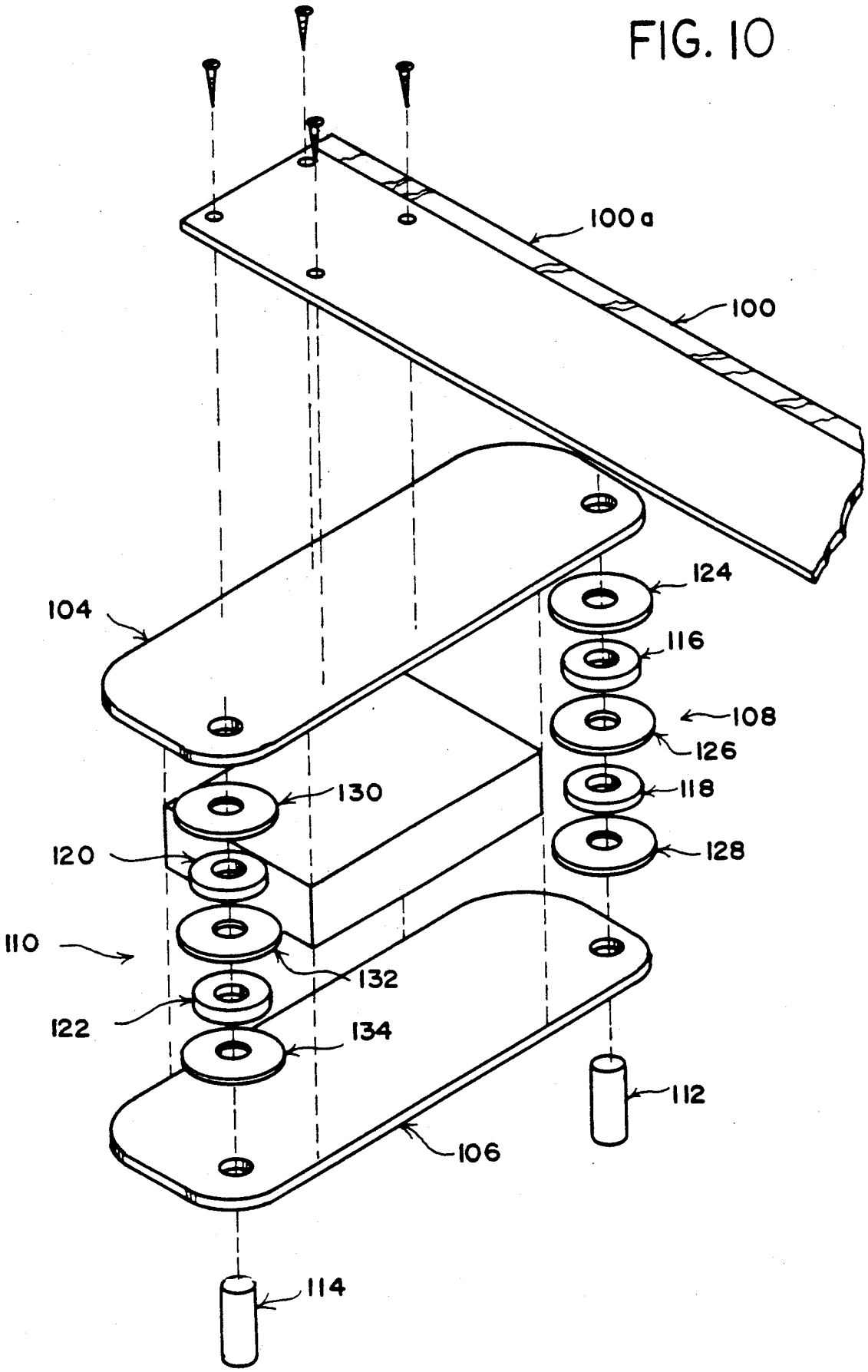
FIG. 10 is an exploded view showing the head portion of the T-square of FIG. 9.

Referring to FIGS. 9 and 10, the T-square 98 includes a magnetic roller head 102 which includes a pair of plates 104 and 106 between which a pair of magnetic rollers 108 and 110 are rotatably supported on corresponding shafts 112 and 114. Each of the rollers 108 and 110 is an assembly of disk-shaped magnets 116, 118, 120 and 122 which are disposed between metal Washers 124, 126, 128, 130, 132 and 134. Thus, the rollers 108 and 110 are magnetically attracted to the metal rib 92, so that the T-square 98 is guided along the arcuate path of the arcuate guide board. The straight edge portion 100 has a drawing edge 100*a* which passes exactly through the center of the magnetic roller head so that no matter where the magnetic roller head 102 is disposed along the arcuate metal rib 92, the drawing edge 100*a* will always be at 90° to a tangent of the arcuate metal rib 92 at the point where the drawing edge 100 intersects the arc.

Figure 11:
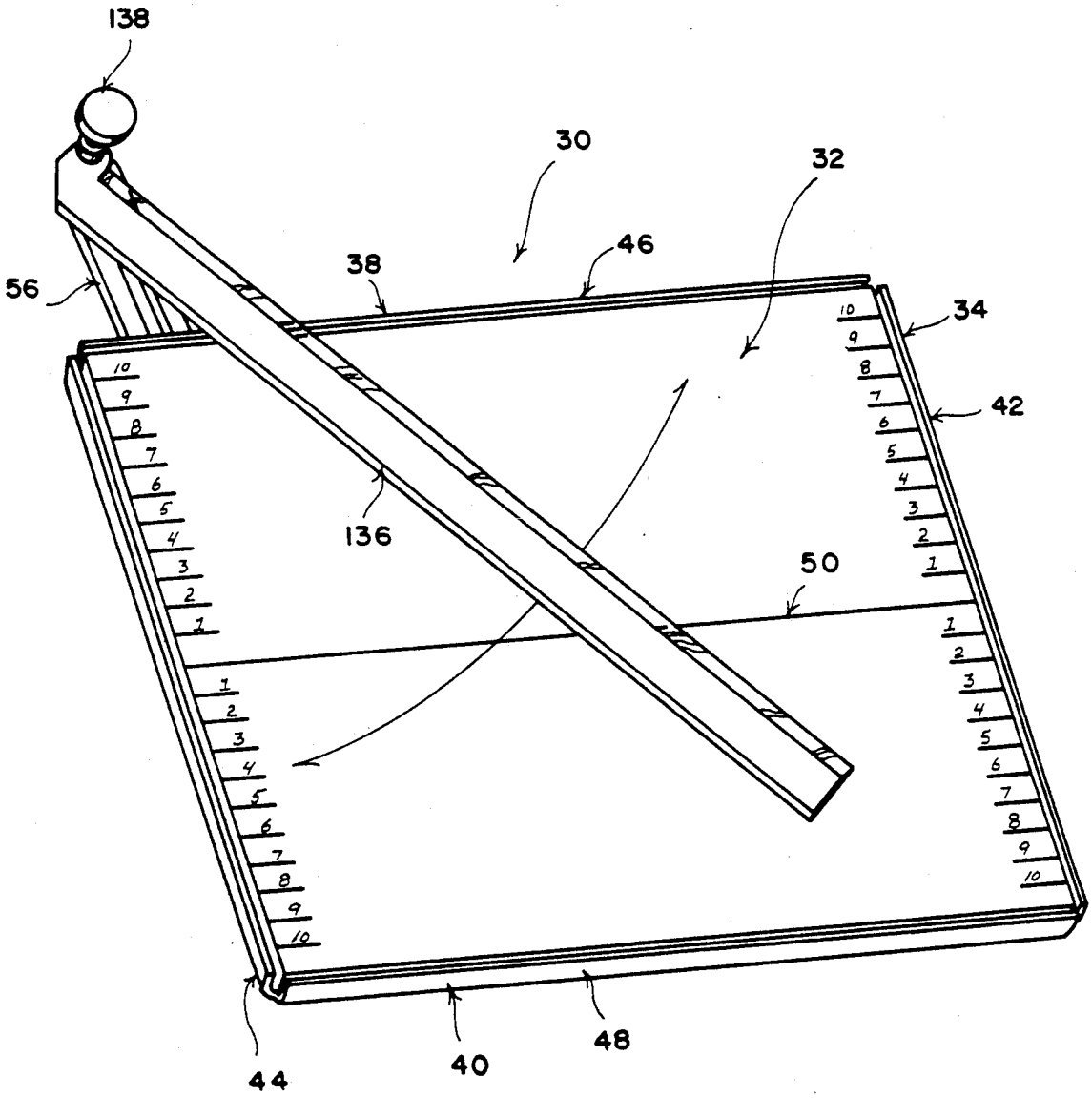
FIG. 11 is a perspective view of the drawing board of the drafting apparatus of the present invention, and including a long straight edge attached to the back of the drawing board for drawing roof lines.
Figure 12:
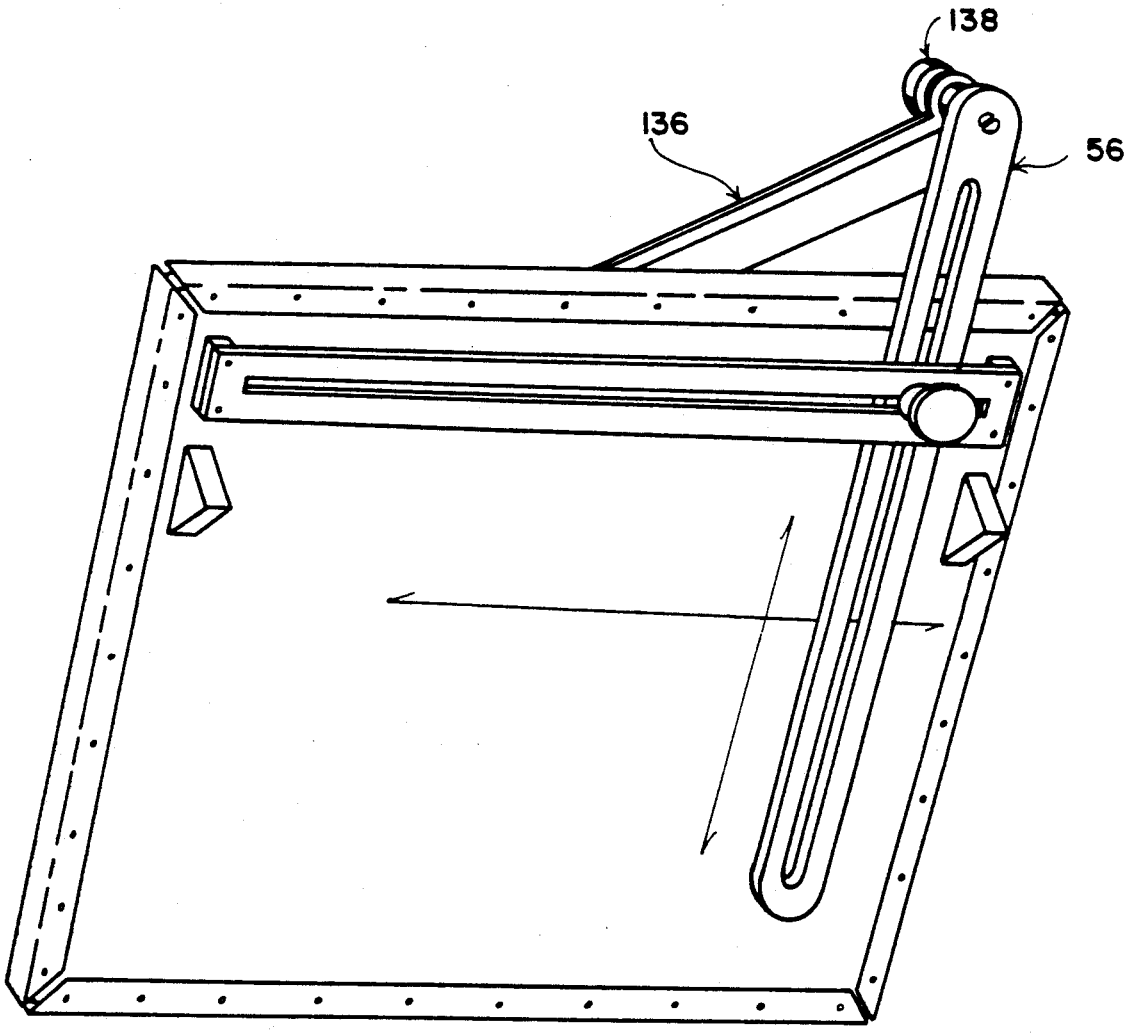
FIG. 12 is a perspective view from the back side of the drawing board according to the present invention and showing an adjacent arm for pivotally supporting the roof line straight edge.

Referring to FIG. 11, an additional straight edge 136 is detachably coupled to the arm 56 and is angularly adjustable by means of a knob 138. The straight edge 136 is used to provide a pivot point above and outside the drawing board area. It is typically be used for drawing roof lines or similar lines.

Figure 14:
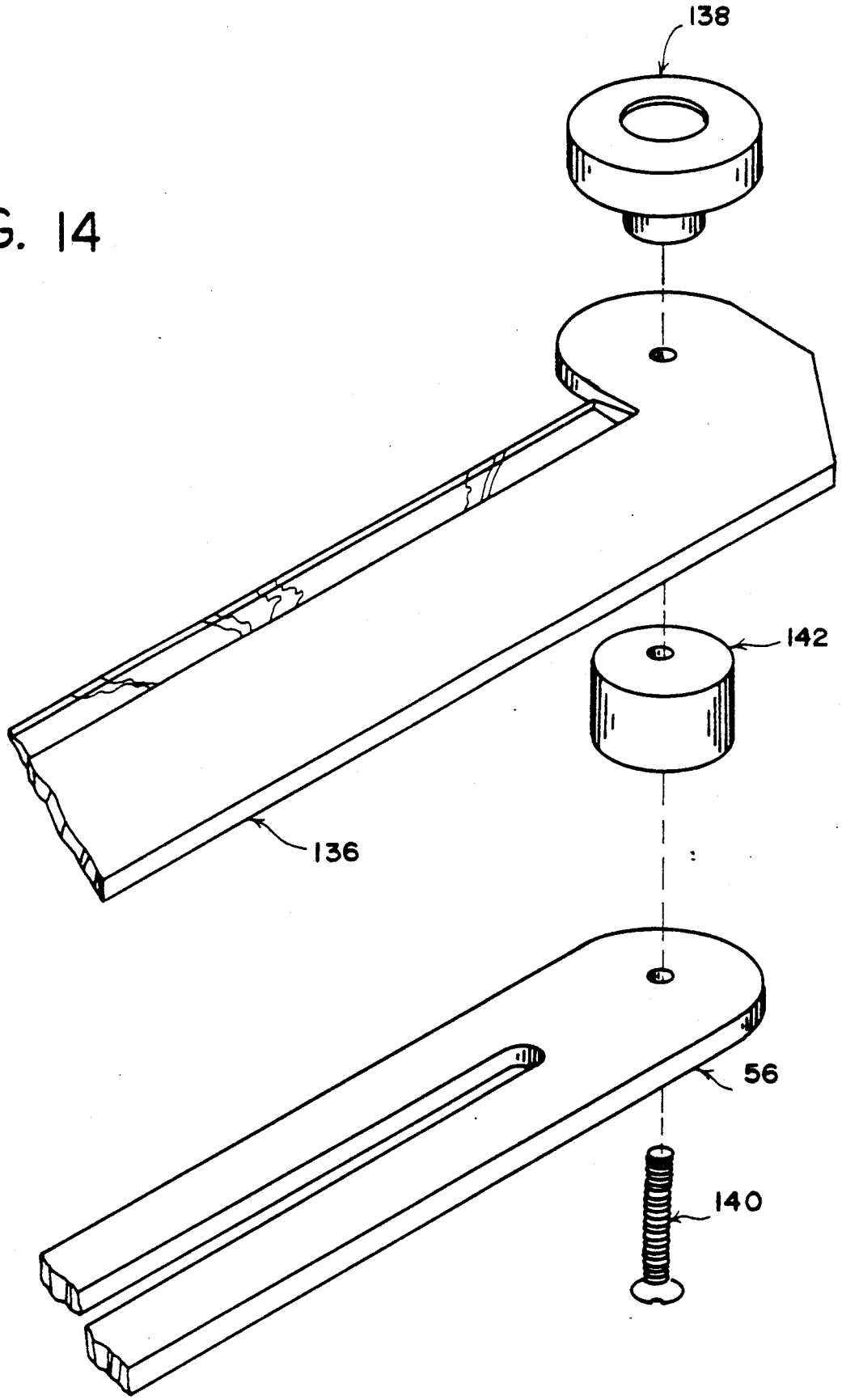
FIG. 14 is an enlarged, exploded view showing an attachment knob, the roof line straight edge and the adjustable arm.

FIG. 14 shows how the straight edge 136 is connected to the arm 56. The knob 138 has a threaded bore which receives a screw 140. A cylindrical spacer 142 is disposed between the straight edge 136 and the arm 56.

Figure 15:
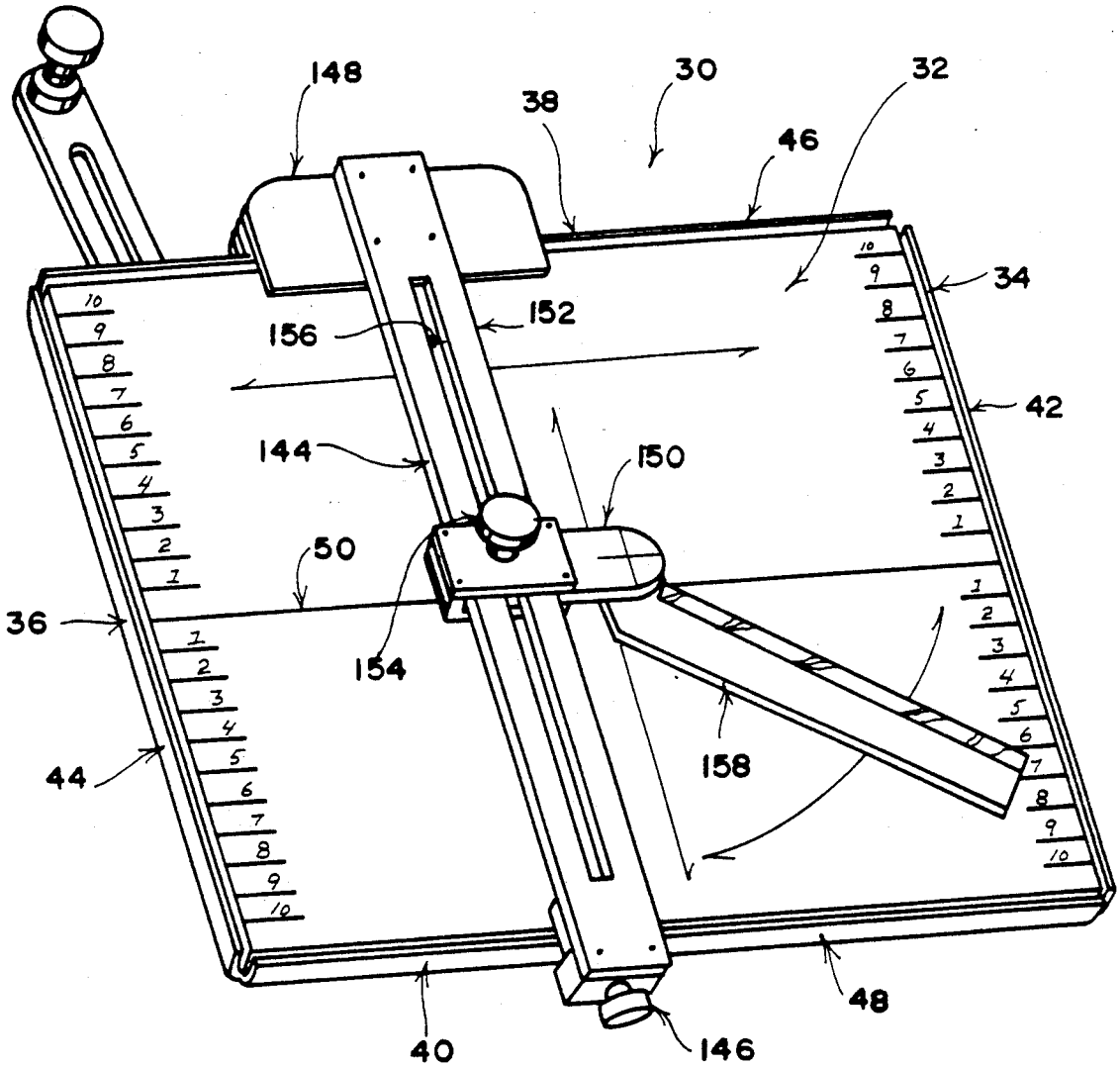
FIG. 15 is a perspective view of the drafting apparatus according to the present invention, and illustrating an optional fixed pivot straight edge on a slide member.
Figure 16:
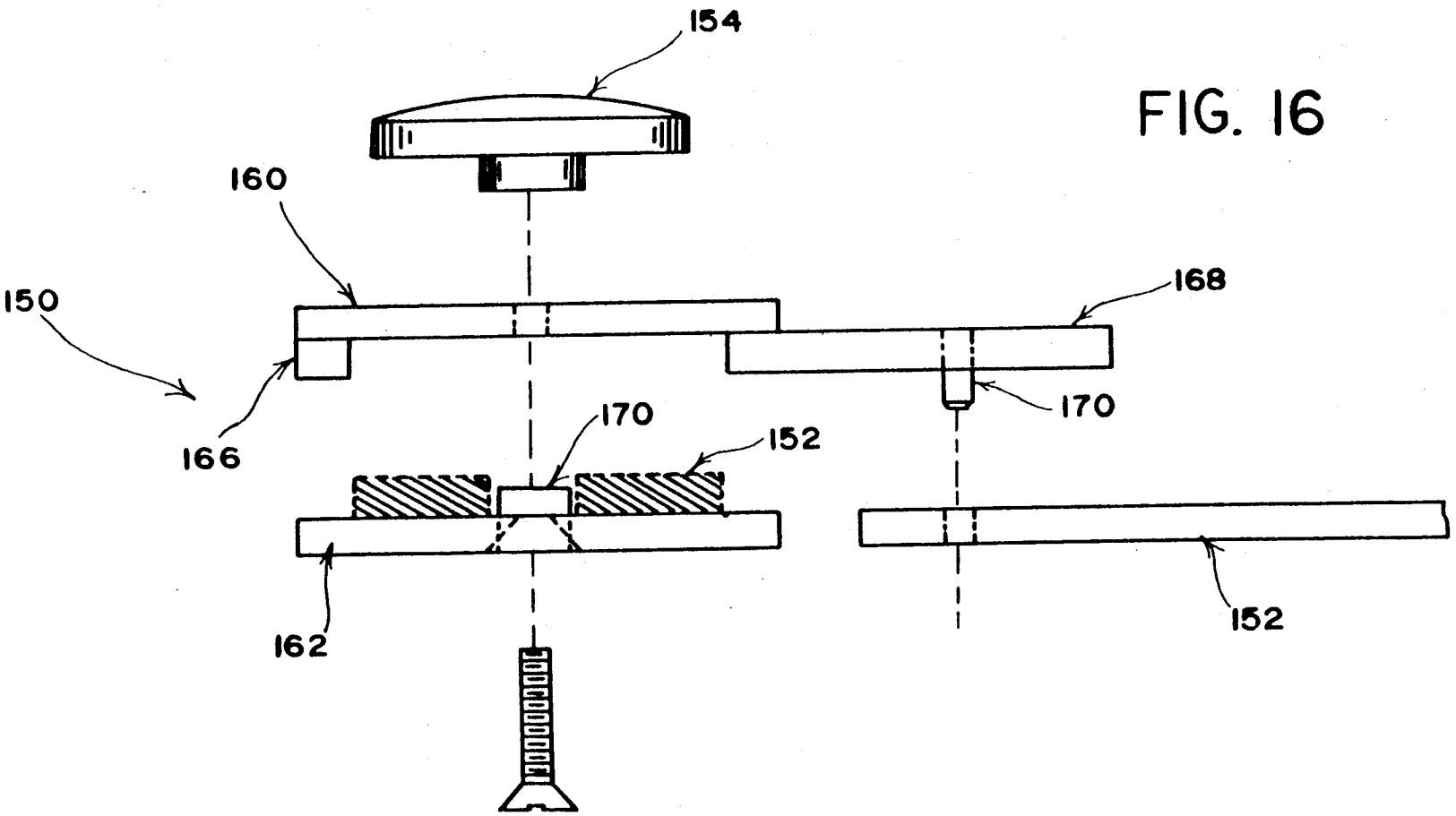
FIG. 16 is an enlarged exploded view of the slide member of the fixed pivot of FIG. 15.
Figure 17:
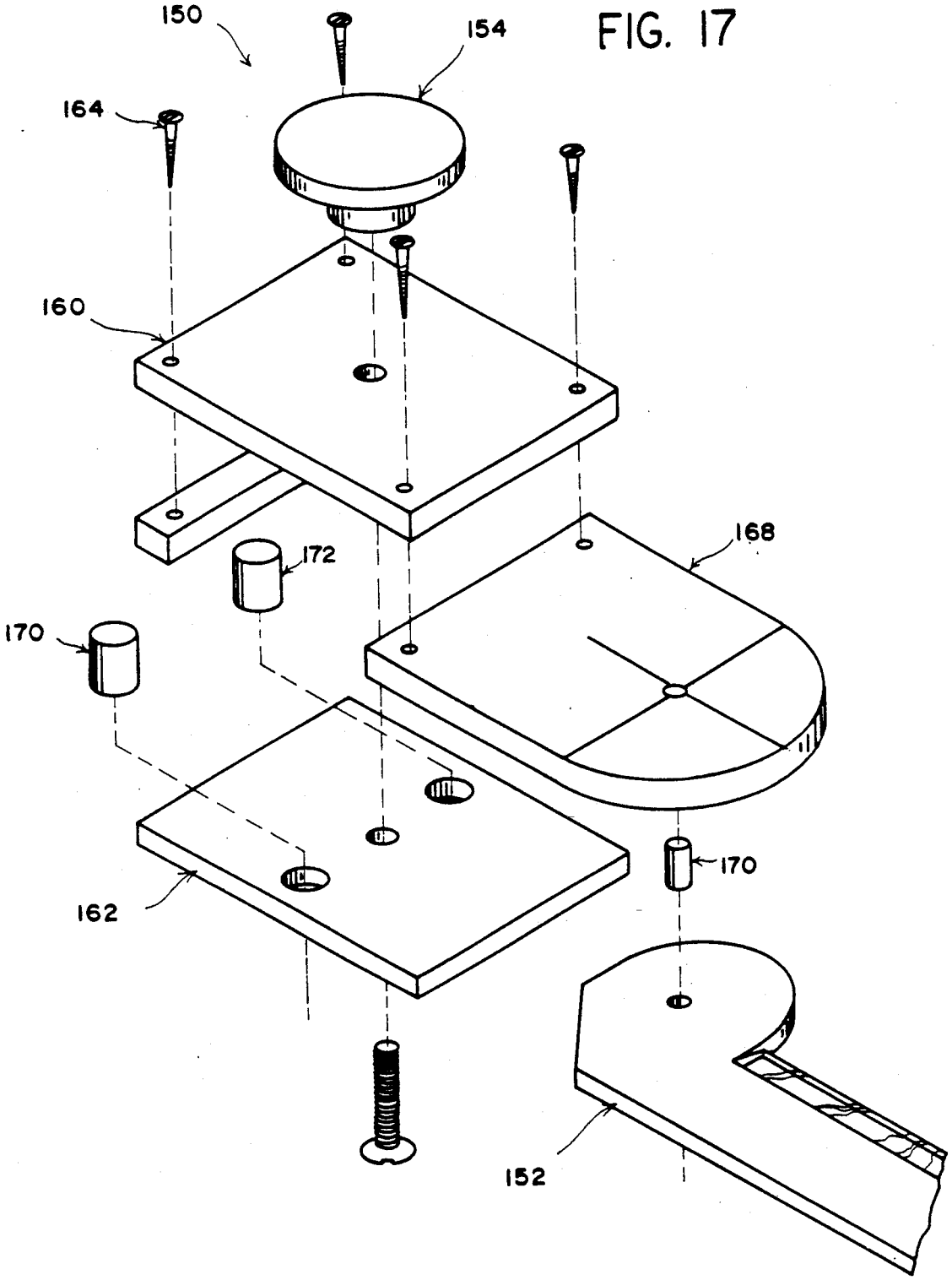
FIG. 17 is an enlarged perspective exploded view of the fixed pivot of FIG. 15.

Referring to FIG. 15, a rolling mechanical head 144 is movable from left-to-right along the upper and lower track segments 46 and 48. Once the desired position is achieved, a locking screw 146 is used to positionally fix the rolling mechanical head 144. Once the screw 146 is loosened, the rolling mechanical head 144 can be completely removed from the drawing board 32 so as to facilitate use of the arcuate guide boards and their corresponding T-squares. A head portion 148 of the rolling mechanical head 144 is provided with magnetic rollers similar to the magnetic roller head 102 of the T-square 98. A pivot head 150 is slidable along a straight edge 152 and is positionally adjustable by loosening a knob 154 which threadedly engages a screw passing through a slot 156 formed in the straight edge 152. A pivoting straight edge 158 is pivotally mounted to the pivot head 150, which is provided with cross hairs which indicate the pivot axis of the straight edge 158. Two different views of the pivot head 150 are shown in FIGS. 16 and 17. A space in which the straight edge 152 is slidable is formed by an upper plate 160 which is coupled to a lower plate 162 with threaded fasteners, such as screws 164. A spacer bar 166 is disposed at one side, while a protruding pivot mounting plate 168 is provided at the opposite side. The mounting plate 168 has a pivot pin 170 which extends downwardly to engage the straight edge 152. A pair of guides 170 and 172 are also mounted between the upper and lower plates and ride in the slot 156 of the straight edge 152, thereby ensuring linear motion of the pivot head 150.

Figure 20:
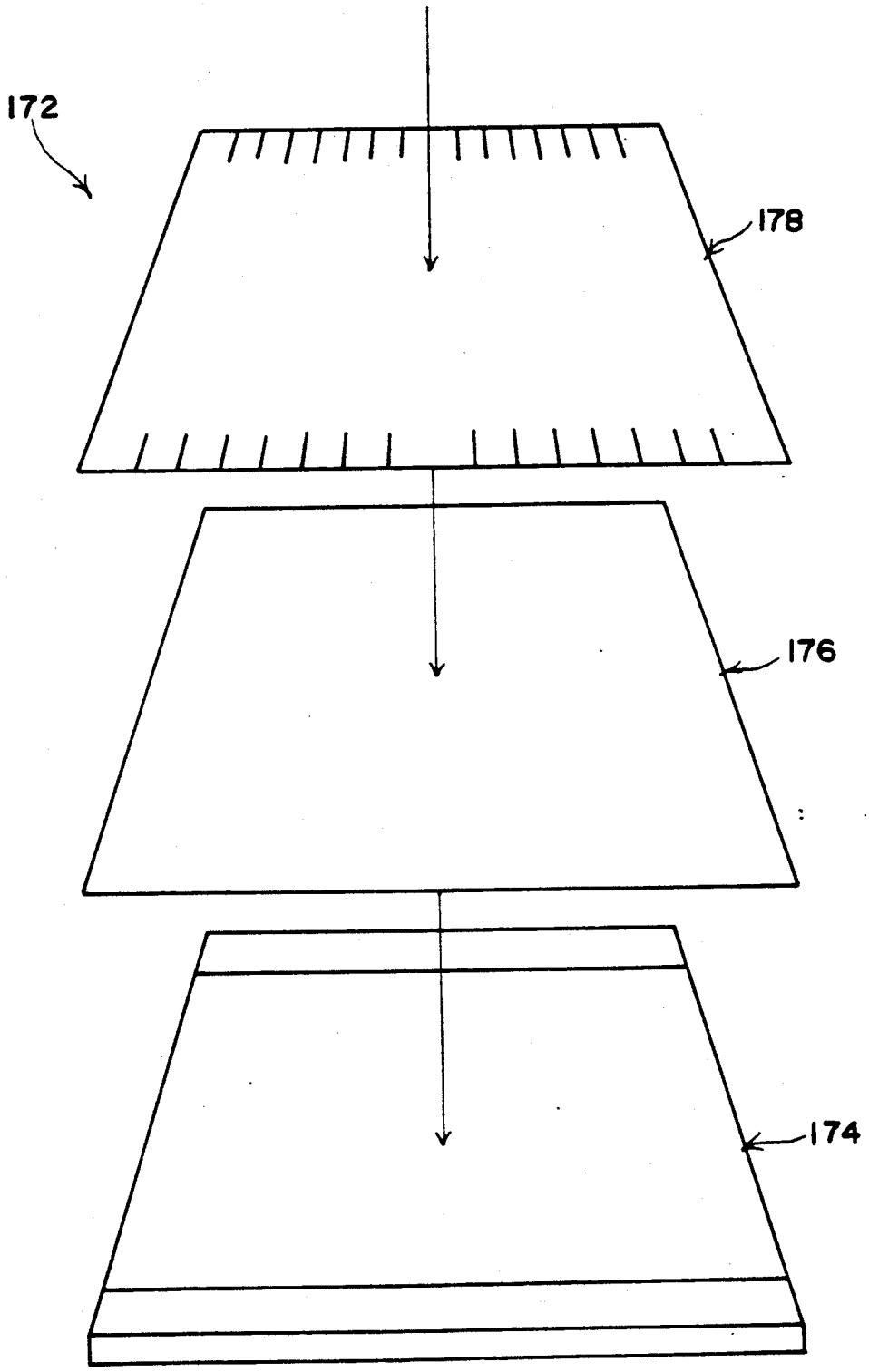
FIG. 20 is an exploded view showing a three layer construction for a drawing board according to another embodiment of the present invention.

In an alternative embodiment of the present invention, the rolling mechanical head 144 is replaced by an independently movable magnetic stylus which cooperates with a metallic drawing board. Referring to FIG. 20, a magnetic drawing board 172 is made as a layered structure in which a base board 174 has a mild steel sheet 176 connected thereto by suitable means, such as adhesive bonding. The sheet metal is overlaid with a vinyl cover sheet 178 which is provided with pick marks as in the previous embodiment. The steel sheets 176 is thus sandwiched between the base board 174 and the vinyl cover sheet 178.

Figure 21:
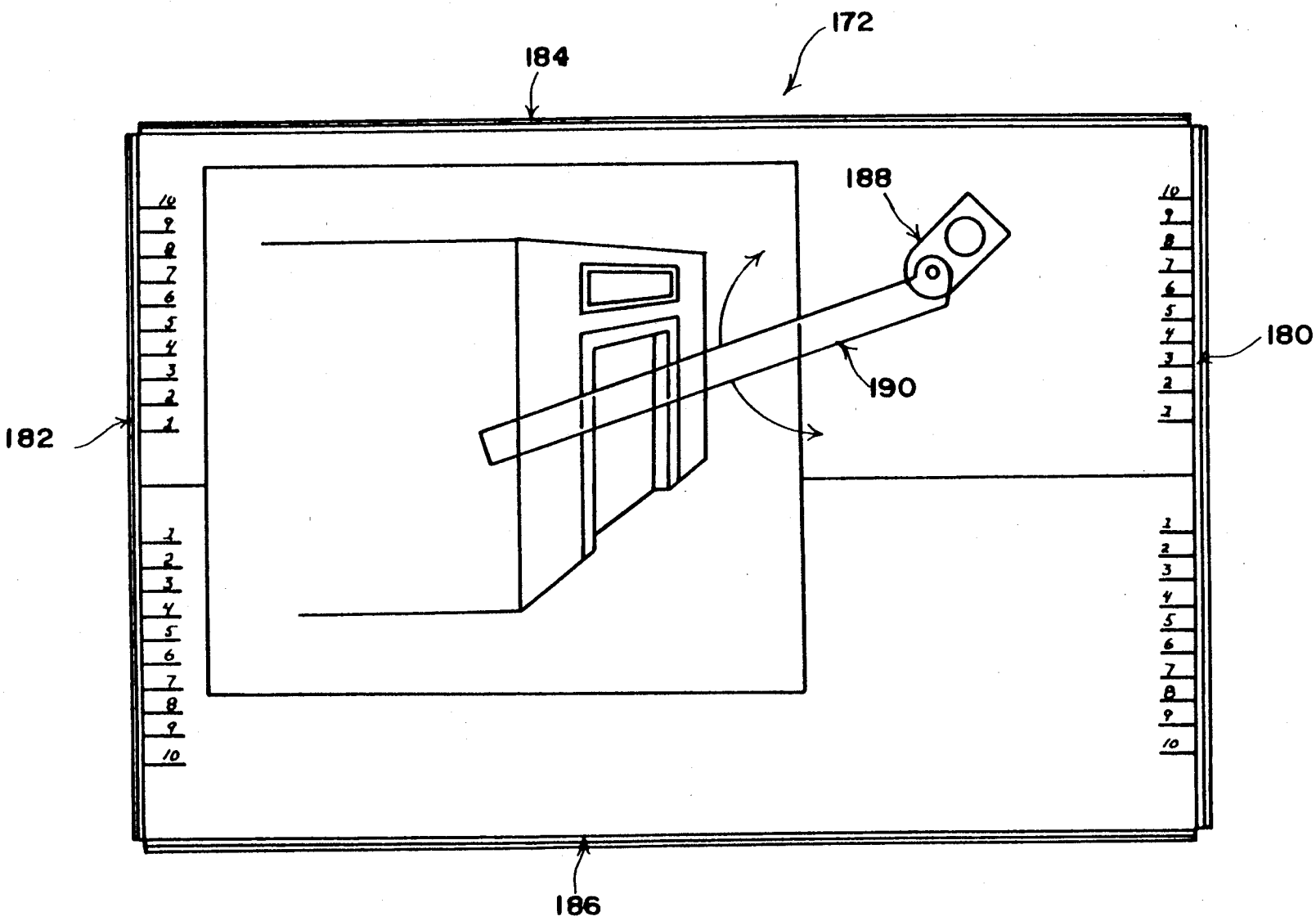
FIG. 21 is a top view of the drawing board of FIG. 20 with a magnetically attached fixed pivot member.
Figure 22:
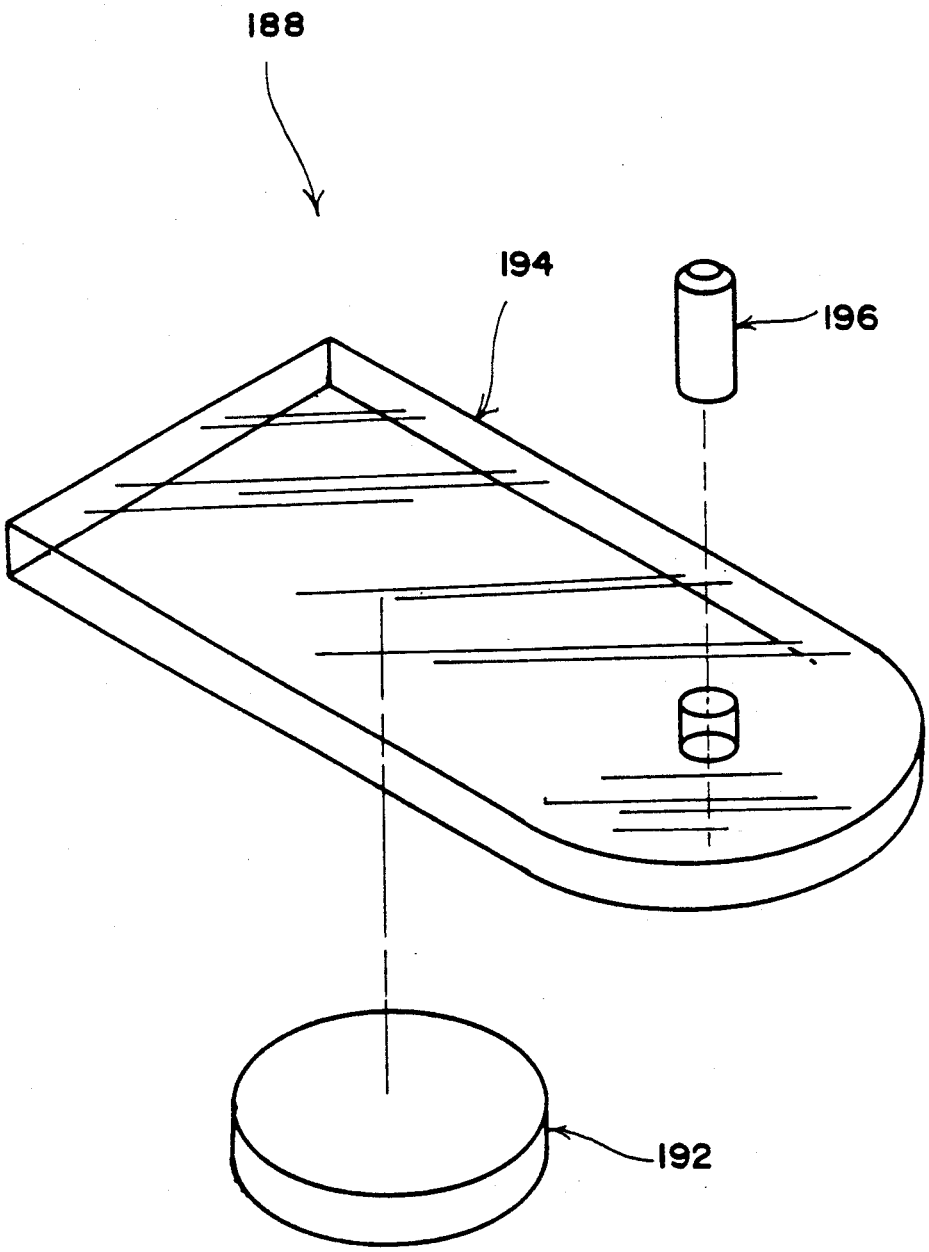
FIG. 22 is a perspective, exploded view of a pivot head used in conjunction with a magnetic drawing board according to the present invention.

The assembled, composite drawing board 172 is illustrated in FIG. 21, and is provided with track segments 180, 182, 184, and 186 for attaching the arcuate guide boards as in the previously described embodiment. A magnetic fixed pivot member 188 pivotally carries a straight edge 190. The fixed pivot member 188, as shown in FIG. 22, includes a disk-shaped magnetic 192 which is fixedly connected to a lower surface of a clear plastic body member 194 by any suitable means, such as adhesive bonding. A pivot pin 196 extends downwardly from the lower surface of the body member 194 and rotatably supports the straight edge 190. The straight edge 190 may be replaced with different lengths by simply lifting the body and removing the pivot pin from the mounting hole of the straight edge. Each straight edge, of any desired length, is designed to be thinner than the magnet so as to give sufficient room for rotational movement. Preferably, the magnet is coated with a material that has a high coefficient of friction on the bottom so as to resist any movement caused by lateral pressure on the body, such as when the straight edge is rotated about the pivot pin 196.

Figure 18:
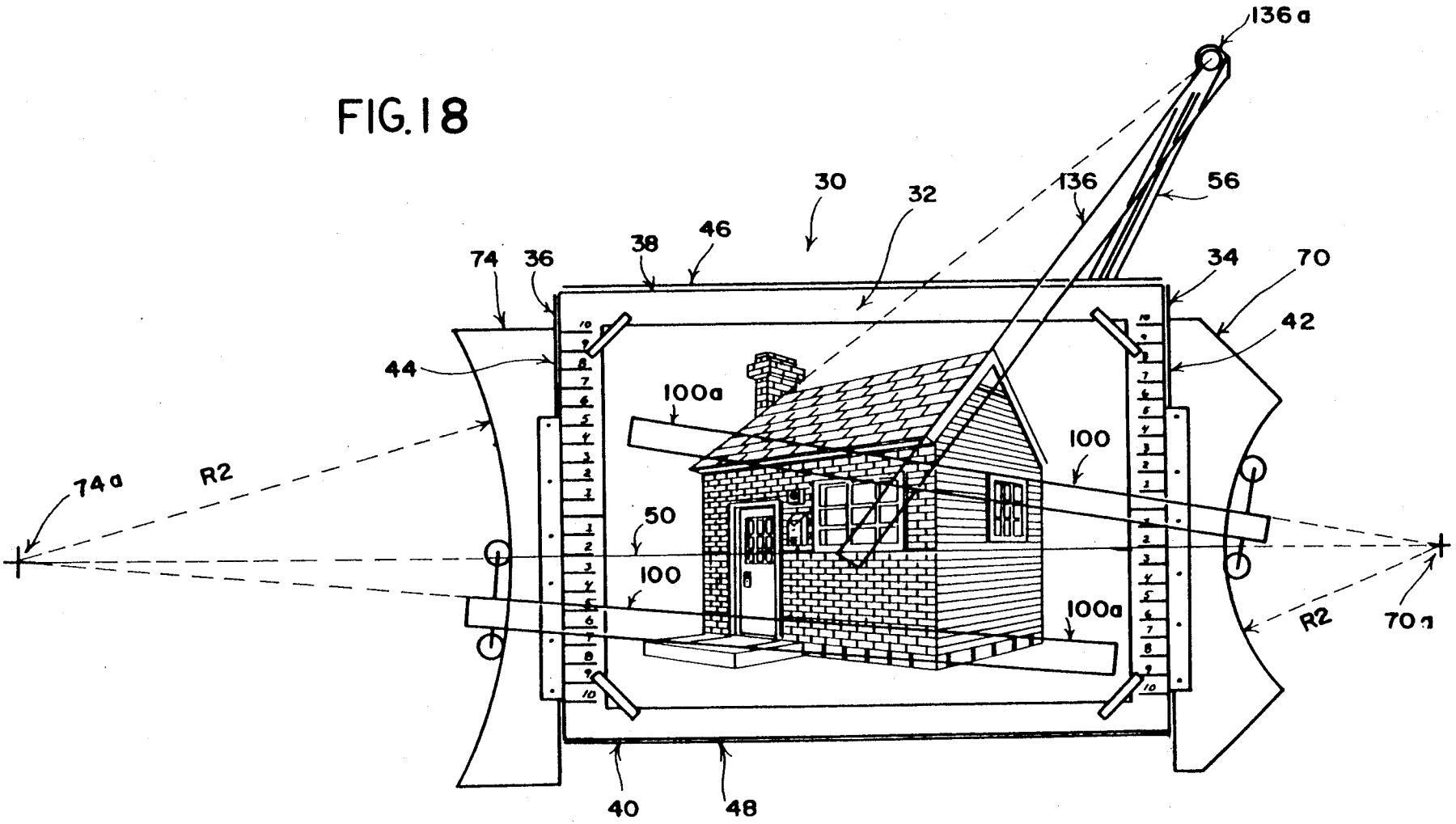
FIG. 18 is a top view of the drafting apparatus according to the present invention and showing a perspective view of a house drawn using the drafting apparatus according to the present invention.

Referring now to FIG. 18, the drafting apparatus 3 of the present invention is illustrated as having two arcuate guide boards 74 and 70 attachably coupled to the opposite sides 36 and 34 of the drawing board 32 at the tracks 44 and 42. In the illustration, arcuate guide boards 74 and 70 result in complimentary angles for the perspective view. The horizon 50, which was selected for this particular illustration, passes through the middle of each of the arcuate guide boards 74 and 70. The pivot point of the arcuate guide board 70 is illustrated as numeral 70*a*, while the pivot point for arcuate guide boards 74 is illustrated as numeral 74*a*. The horizon 50 passes through both of the pivot points 70*a* and 74*a*, as shown by the broken lines. Also, a radius R1 of the arcuate guide board 70 is colinear with the drawing edge 100*a* of the straight edge 100 (the illustration of FIG. 18 shows two T-squares, with the magnetic roller heads illustrated schematically). Also, the radius R2 of the arcuate guide board 74 is colinear with the other straight edge 100. When two arcuate guide boards are used as shown to create complimentary angles, the invention may use either a single T-square which is reversible to be used on the right or left hand side, or two separate T-squares could be provided, one for each of the right and left hand sides.

Also shown in FIG. 18 is the straight edge 136 which is pivotally attached to the arm 56 for drawing the roof line. The straight edge 136 pivots about the pivot point 136*a*, so that the roof lines can be drawn simply by rotating the straight edge 136 from the fixed pivot point 136*a*.

Figure 19:
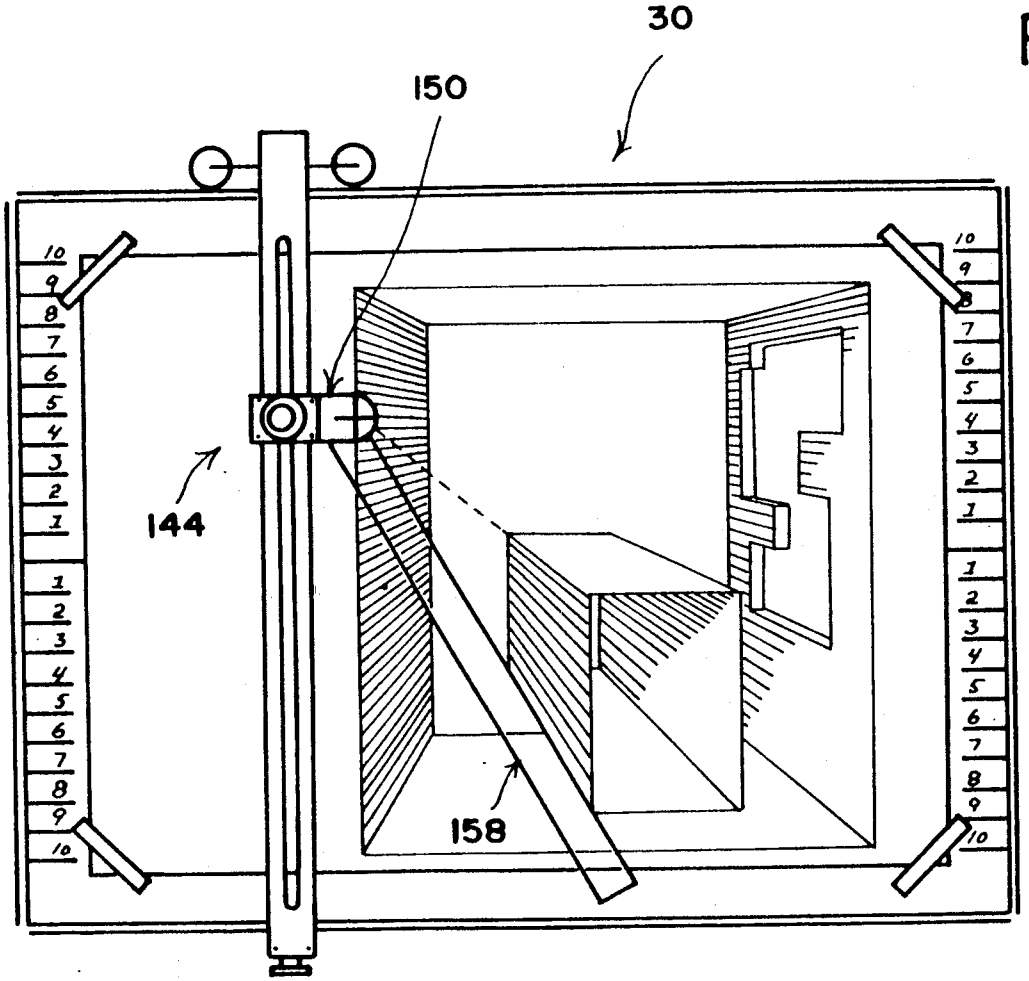
FIG. 19 is a top view of the drawing board and a fixed pivot, with a perspective rendering illustrated thereon.

FIG. 19 illustrates how the drafting apparatus 30 can be used to create radiating perspective lines with the straight edge 158 which is pivotally supported by the pivot head 150. It is to be understood that the entire rolling mechanical head 144, which includes the straight edge 158 and pivot head 150 could be replaced by the magnetic fixed pivot member 188 which was described with reference to FIGS. 20–22, when used in conjunction with a magnetic board.

Numerous modifications and adaptations of the present invention will be apparent to those so skilled in the art and thus, it is intended by the following claims to cover all such modifications and adaptations which fall within the true spirit and scope of the invention.

What is claimed is:

1. A drafting apparatus comprising:

a straight edge;

a drawing board having two opposite, parallel side edges, a top edge and a bottom edge;

a plurality of arcuate guide boards, each having a flat surface, a concave arcuate guide surface of predetermined radius of curvature, the concave arcuate guide surface of each guide board being capable of guiding the straight edge along a radial path during formation of radiating perspective lines, and each concave arcuate guide surface having an apex point corresponding to a horizon line; and track means, provided on at least the two opposite parallel side edges of the drawing board, for detachably coupling any one of the guide boards to one of the two opposite parallel side edges of the drawing board with the horizon line of each coupled concave arcuate guide board at a various positions along the coupled opposite side edge.

2. A drafting apparatus according to claim 1, wherein two arcuate guide boards selected from the plurality of arcuate guide boards and coupled to the two opposite parallel side edges have different radii of curvature selected to guide the straight edge for drawing complimentary radiating perspective lines.

3. A drafting apparatus according to claim 1, further comprising an adjustable arm adjustably connected to the drawing board, and a straight edge detachably coupled to the adjustable arm, the straight edge having a pivot point disposed above the drawing board.

4. A drafting apparatus according to claim 3, wherein the adjustable arm includes a bar fixedly connected to an under surface of the drawing board and having a slot provided longitudinally therein, wherein the adjustable arm has a longitudinally disposed slot which intersects the longitudinal slot of the bar, and an adjustment knob engages a bolt passing through the two longitudinal slots for selectively gripping and releasing the straight edge.

5. A drafting apparatus according to claim 1, wherein the track means comprises four track segments corresponding to one track segment mounted to each edge of the drawing board and one slide member mounted to each flat surface of each guide board, each slide member being fitted into any one of the track segments.

6. A drafting apparatus according to claim 5, wherein the horizon lines of two arcuate guide boards mounted respectively on the two parallel opposite side edges of the drawing board are horizontally aligned to define a horizon of the drawing board.

7. A drafting apparatus according to claim 1, wherein the straight edge is a T-square having a straight edge portion including a straight edge and a roller head having two rollers engaging the concave arcuate guide surface of the arcuate guide boards, wherein the straight edge is centered between the two rollers.

* * * * *